US011478905B1

(12) United States Patent
Janzen, III

(10) Patent No.: US 11,478,905 B1
(45) Date of Patent: Oct. 25, 2022

(54) SOCKETS WITH MULTI-SIDED OUTER SURFACES

(71) Applicant: Herman William Janzen, III, Lakewood, WA (US)

(72) Inventor: Herman William Janzen, III, Lakewood, WA (US)

(73) Assignee: Herman William Janzen, III, Lakewood, WA (US)

( * ) Notice: Subject to any disclaimer, the term of this patent is extended or adjusted under 35 U.S.C. 154(b) by 0 days.

(21) Appl. No.: 17/713,049

(22) Filed: Apr. 4, 2022

(51) Int. Cl.
*B25B 13/06* (2006.01)

(52) U.S. Cl.
CPC ..... *B25B 13/065* (2013.01)

(58) Field of Classification Search
CPC ..... B25B 13/065; B25B 13/06
See application file for complete search history.

(56) References Cited

U.S. PATENT DOCUMENTS 1,360,121 A * 11/1920 Lawrence ..... B25B 13/06 81/124.4
2,581,095 A * 1/1952 Godmaire ..... B25B 13/065 81/124.3
3,651,720 A * 3/1972 Indyk ..... B25B 13/06 81/185
4,798,111 A * 1/1989 Cheeseman ..... B25B 13/06 81/177.4
4,882,958 A * 11/1989 McNeeley ..... B25B 13/56 81/439
D381,247 S * 7/1997 Zayat, Jr. ..... D8/29
5,943,924 A * 8/1999 Jarvis ..... B25G 1/043 81/185
5,957,012 A * 9/1999 McCune ..... B25B 23/0035 81/185
6,282,994 B1 * 9/2001 Wei ..... B25B 13/06 81/121.1
D464,545 S * 10/2002 Marty ..... D8/21
D466,766 S * 12/2002 Marty ..... B25B 13/56 D8/21
6,951,156 B2 * 10/2005 Garg ..... B25B 13/06 81/121.1
7,406,895 B2 * 8/2008 Hu ..... B25B 13/06 81/124.6
8,205,529 B1 * 6/2012 Laurie ..... B25B 23/0021 81/177.85
8,752,455 B1 * 6/2014 Taylor, Jr. ..... B25B 13/58 81/DIG. 11
10,688,630 B2 * 6/2020 Feuerstein ..... B25B 13/46
2005/0098001 A1 * 5/2005 Walker ..... G09F 3/00 81/439

(Continued)

*Primary Examiner* — David B. Thomas
(74) *Attorney, Agent, or Firm* — Perkins Coie LLP

(57) ABSTRACT

Devices or sockets having multi-sided outer surfaces are disclosed herein. An exemplary device can include an outer surface comprising multiple outer sides; an inner surface comprising multiple inner sides; a first end portion; a second end portion opposite the first end portion; a first recess extending from the first end portion toward the second end portion; and a second recess extending from the second end portion toward the first end portion. The second recess can include a cross-sectional dimension smaller than the cross-sectional dimension of the first recess. The device can be a hexagonal socket. In some embodiments, individual sockets are stackable on and within one another.

20 Claims, 5 Drawing Sheets

(56) References Cited

U.S. PATENT DOCUMENTS

| | | | | |
|---|---|---|---|---|
| 2012/0073408 | A1* | 3/2012 | Leighton | B25B 13/481<br>81/177.2 |
| 2016/0221160 | A1* | 8/2016 | Boland | B25B 13/06 |
| 2017/0266786 | A1* | 9/2017 | Rydberg | B25B 13/06 |
| 2020/0298377 | A1* | 9/2020 | Wilson | B25B 23/0035 |
| 2021/0138620 | A1* | 5/2021 | Margol | B25B 13/465 |

* cited by examiner

SOCKETS WITH MULTI-SIDED OUTER SURFACES

TECHNICAL FIELD

This present disclosure relates to sockets with multi-sided outer surfaces. Particular embodiments relate to sockets that are stackable and/or have a hexagonal outer surface.

BACKGROUND

Traditional sockets have hexagonal inner surfaces and round outer surfaces. As a result, when traditional round sockets are dropped or mishandled, they can roll away and be an inconvenience for the user. Additionally, the round outer surface prevents or inhibits the ability for an adjustable wrench or related tool to securely fasten to the round outer surface and turn these traditional sockets. This is another inconvenience of traditional sockets, especially given the sometimes hard-to-reach positions of the hexagonal nuts that the sockets are to be coupled to. Accordingly, there exists a need for an improved socket design.

BRIEF DESCRIPTION OF THE DRAWINGS

Features, aspects, and advantages of the presently disclosed technology may be better understood with regard to the following drawings. The components in the drawings are not necessarily to scale. Instead, emphasis is placed on illustrating clearly the principles of the present disclosure.

Figure 1A:
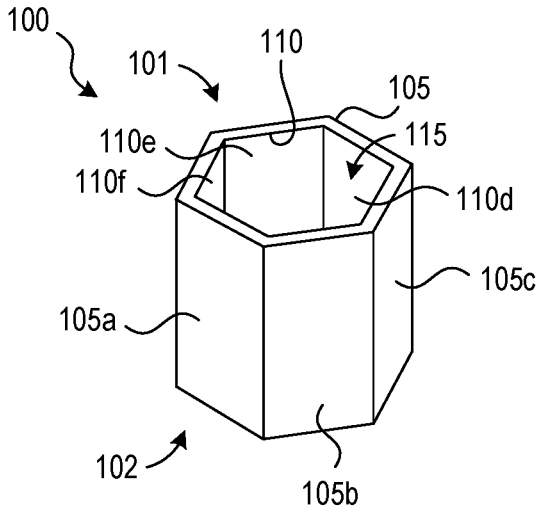
FIGS. 1A and 1B are opposing isometric views of a socket configured in accordance with embodiments of the present technology.

A person skilled in the relevant art will understand that the features shown in the drawings are for purposes of illustrations, and variations, including different and/or additional features and arrangements thereof, are possible.

DETAILED DESCRIPTION

A. Overview

Traditional sockets have hexagonal inner surfaces and round outer surfaces and, as a result, have multiple deficiencies. For example, when traditional round sockets are dropped or mishandled, they can roll away and be an inconvenience for the user. As another example, the round outer surface prevents or inhibits the ability for an adjustable wrench or related tools to securely fasten and turn the traditional round sockets.

Embodiments of the present technology address at least some of these issues. For example, embodiments of the present technology include a socket configured to engage a hexagonal nut or member and which has a multi-sided and/or hexagonal outer surface. In particular embodiments, such a socket comprises an outer surface including multiple outer sides extending along an entire length of the device, an inner surface comprising multiple inner sides, and opposing first and second end portions. Each of the outer sides can have a corresponding inner side that is parallel to the outer side. The socket can further comprise a first recess including a first cross-sectional dimension at the first end portion and, and a second recess including a second cross-sectional dimension, smaller than the first cross-sectional dimension, at the second end portion. In some embodiments, the first recess is configured to receive other sockets of similar design and a smaller outer cross-sectional dimension. As such, multiple sockets configured in accordance with embodiments of the present technology can be stacked together (e.g., on top of or over one another).

These structural features enable embodiments of the present technology to have multiple advantages over conventional sockets. For example, sockets configured in accordance with the present technology can be gripped by their outer surface and turned with an adjustable wrench and, due to the multi-sided outer surface, do not easily roll away when dropped. In some embodiments, sockets configured in accordance with the present technology can also be stacked together (e.g., on top of one another) while still performing their desired function. That is, the sockets can be utilized (e.g., to turn nuts and bolts) even in a stacked configuration. Moreover, relative to traditional sockets with round outer surfaces, the stacked configuration of the sockets described herein is expected to enable the sockets to be more easily stored in a compact manner.

In the Figures, identical reference numbers identify generally similar, and/or identical, elements. Many of the details, dimensions, and other features shown in the Figures are merely illustrative of particular embodiments of the disclosed technology. Accordingly, other embodiments can have other details, dimensions, and features without departing from the spirit or scope of the disclosure. In addition, those of ordinary skill in the art will appreciate that further embodiments of the various disclosed technologies can be practiced without several of the details described below.

B. Sockets and Related Devices

Figure 1B:
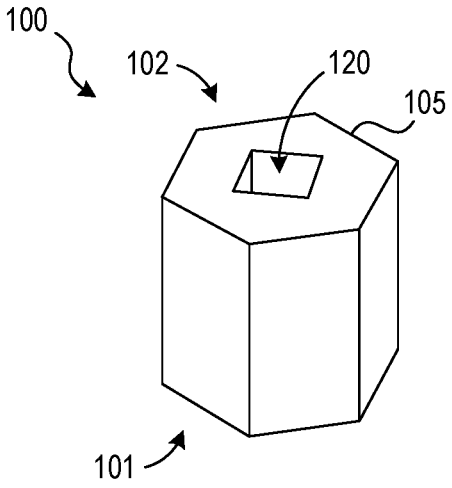

FIGS. 1A and 1B are opposing isometric views of a socket or device 100 ("socket 100") configured in accordance with embodiments of the present technology. Referring to FIGS. 1A and 1B together, the socket 100 includes an outer surface 105 extending along a length of the socket 100, an inner surface 110 (FIG. 1A) extending along less than an entire length of the socket 100, a first end portion 101, and a second end portion 102 opposing the first end portion 101. The socket 100 can comprise, consist of, or be made from steel, polymer, or other rigid material that is not brittle and can withstand a pressure and/or torque typically applied to sockets by drive members.

The socket 100 can further include (a) a first recess 115 (FIG. 1A) defined by the inner surface 110 and having a first outer cross-sectional dimension, and (b) a second recess 120 (FIG. 1B) at the second end portion 102 and having a second outer cross-sectional dimension smaller than the first outer cross-sectional dimension. As explained herein, the first recess 115 can be configured to receive other sockets of similar design, but that have a smaller outer cross-sectional dimension than that of the socket 100, and the second recess 120 can be configured to receive a drive member (as described with reference to FIG. 6) to turn the socket. As shown in FIG. 1A, the first recess 115 has a hexagonal shape and six sides, however in other embodiments the first recess 115 can have a different polygonal shape (e.g., a triangle, square, pentagon, etc.) and/or more or fewer sides (e.g., three sides, four sides, eight sides, etc.). As shown in FIG. 1B, the second recess 120 has a square shape and four sides, however in other embodiments the second recess 120 can have a different polygonal shape (e.g., a triangle, pentagon, hexagon, etc.) and/or more or fewer sides (e.g., three sides, four sides, eight sides, etc.), e.g., such that the second recess 120 is configured to receive a desired drive member.

Each of the outer surface 105 and the inner surface 110 is multi-sided and thus includes multiple sides or faces ("sides"). For example, the outer surface 105 includes a first outer side 105*a*, a second outer side 105*b* extending from the first outer side 105*a*, a third outer side 105*c* extending from the second outer side 105*b*, a fourth outer side 105*d* extending from the third outer side 105*c*, a fifth outer side 105*e* extending from the fourth outer side 105*d*, and a sixth outer side 105*f* extending from the fifth outer side 105*e* to the first outer side 105*a*. Similarly, the inner surface 110 includes a first inner side 110*a*, a second inner side 110*b* extending from the first inner side 110*a*, a third inner side 110*c* extending from the second inner side 110*b*, a fourth inner side 110*d* extending from the third inner side 110*c*, a fifth inner side 110*e* extending from the fourth inner side 110*d*, and a sixth inner side 110*f* extending from the fifth inner side 110*e* to the first inner side 110*a*. For illustrative purposes, only some sides of the outer surface 105 and inner surface 110 are shown in FIG. 1A. As previously described, the outer surface 105 can extend along an entire length of the socket 100, thereby providing more surface area to be gripped (e.g., by an adjustable wrench) and providing additional utility for the user. Additionally or alternatively, the outer cross-sectional dimension of the socket 100, which is defined by the outer surface 105, can be a uniform outer cross-sectional dimensional along the entire length of the socket 100.

As shown in FIG. 1A, each side of the inner surface 110 is parallel to a corresponding side of the outer surface 105 at the first end portion 101 and along at least a portion of the length of the socket 100. For example, outer side 105*a* is parallel to inner side 110*a* at the first end portion 101 and outer side 105*b* is parallel to inner side 110*b*, and so on. The corresponding sides (e.g., outer side 105*b* and inner side 105*a*) of the inner surface 110 and outer surface 105 are spaced apart from one another by a thickness, which is described in more detail with reference to FIG. 2C. The thickness can be a uniform thickness extending around the socket 100 at the first end portion 101, or can be a non-uniform thickness.

Figure 2A:
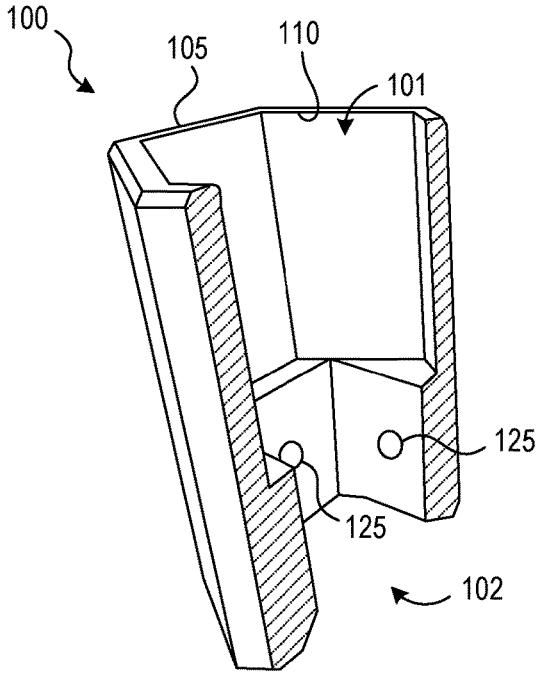
FIG. 2A is a cross-sectional isometric view of the socket of FIGS. 1A and 1B.
Figure 2B:
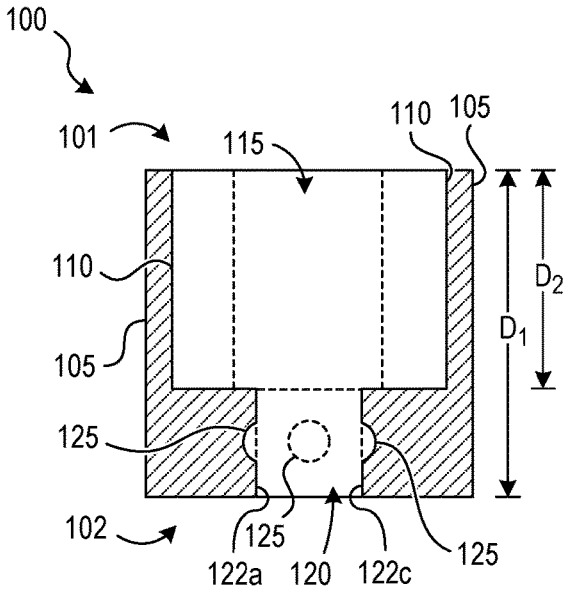
FIG. 2B is a cross-sectional side view of the socket of FIGS. 1A and 1B.

FIGS. 2A and 2B are cross-sectional isometric and side views, respectively, of the socket 100. The socket 100 shown in FIGS. 2A and 2B illustrates many of the aspects described with reference to FIGS. 1A and 1B, including the first end portion 101, the second end portion 102, the outer surface 105, and the inner surface 110. Additionally, as also shown in FIGS. 2A and 2B, the socket 100 includes multiple depressions 125 within individual walls 122 of the second recess 120. For illustrative purposes, only walls 122*a*, 122*c* are shown. The depressions 125 can be used to fixedly couple protrusions of a drive member to the socket 100. As previously described, the socket 100 can further include (a) the first recess 115 (FIG. 2B) defined by the inner surface 110 and having a first outer cross-sectional dimension, and (b) the second recess 120 (FIG. 2B) at the second end portion 102 and having a second outer cross-sectional dimension smaller than the first outer cross-sectional dimension. The first recess 115 can extend from the first end portion 101 toward the second end portion 102 and to an intermediate portion of the socket 100, and the second recess 115 can extend from the second end portion 102 toward the first end portion 101 and to the intermediate portion of the socket 100. The intermediate portion can be closer to the second end portion 102 than the first end portion 101.

As shown in FIG. 2B, the socket 100 can have a length ($D_1$), and an intermediate length ($D_2$) that defines the intermediate portion for which (i) the first recess 115 extends to from the first end portion 101 and (ii) the second recess 120 extends to from the second end portion 102. The length ($D_1$) can be 1.00 inch, 1.34 inches, 1.45 inches, 1.50 inches, 2.00 inches, 3.25 inches, or within a range of 1.00-3.25 inches. The intermediate length ($D_2$) can be 0.625 inches, 0.840 inches, 0.950 inches, 1.000 inches, 1.625 inches, or 2.750 inches.

Figure 2C:
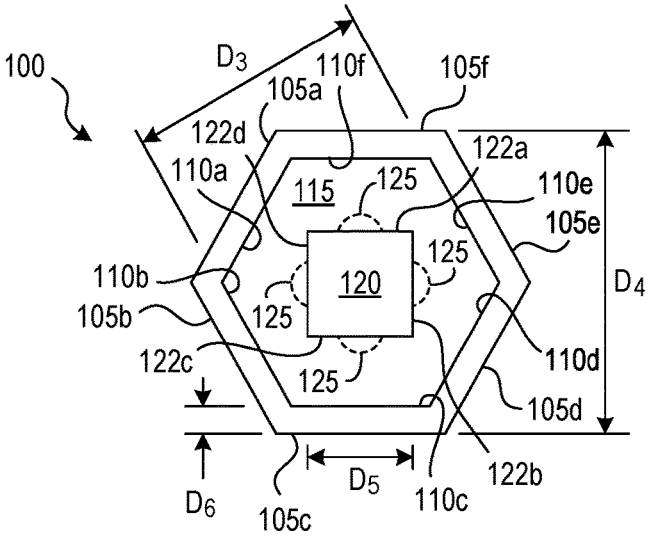
FIG. 2C is a top view of the socket of FIGS. 1A and 1B.

FIG. 2C is a top view of the socket 100. The socket 100 shown in FIG. 2C illustrates many of the aspects previously described, including the inner first side 105*a*, the inner second side 105*b*, the inner third side 105*c*, the inner fourth side 105*d*, the inner fifth side 105*e*, the inner sixth side 105*f*, the outer first side 110*a*, the outer second side 110*b*, the outer third side 110*c*, the outer fourth side 110*d*, the outer fifth side 110*e*, the outer sixth side 110*f*, the first recess 115, the second recess 120, and the depressions 125. As also shown in FIG. 2C, the socket 100 can have (i) an inner cross-sectional dimension ($D_3$) (e.g., the interior socket size) defined by the inner sides 105*a*-f of the inner surface 105, (ii) an outer cross-sectional dimension ($D_4$) (e.g., the exterior socket size) defined by the outer sides 110*a*—f of the outer surface 110, (iii) an outer cross-sectional dimension ($D_5$) (e.g., the drive socket size) defined by walls 122, and (iv) an outer wall thickness ($D_6$) (e.g., the socket wall thickness) defined by the space between corresponding inner and outer sides. The inner cross-sectional dimension ($D_3$) and the outer cross-sectional dimension ($D_4$), and the outer cross-sectional dimension ($D_5$) can be any of the dimensions shown in Table 1 below.

TABLE 1

| | Dimension | | | | | | | | | |
|---|---|---|---|---|---|---|---|---|---|---|
| $D_3$ | 0.25 | 0.3125 | 0.375 | 0.4375 | 0.50 | 0.5625 | 0.625 | 0.6875 | 0.75 | 0.8125 |
| $D_4$ | 0.1874 | 0.25 | 0.375 | 0.4375 | 0.625 | 0.6875 | 0.75 | 0.8125 | 0.875 | 0.9375 |
| | Dimension | | | | | | | | | |
| $D_3$ | 0.875 | 0.9375 | 1 | 1.0625 | 1.125 | 1.1875 | 1.25 | 1.3125 | 1.375 | |
| $D_4$ | 1 | 1.0625 | 1.125 | 1.1875 | 1.25 | 1.4375 | 1.5 | 1.5625 | 1.625 | |

The outer cross-sectional dimension ($D_5$) can be 0.250 inches, 0.375 inches, 0.500 inches, or within a range of 0.250-0.500 inches. The outer wall thickness ($D_6$) can be 0.0625 inches, 0.0937 inches, 0.125 inches, or within a range of 0.0625-0.125 inches.

Figure 3A:
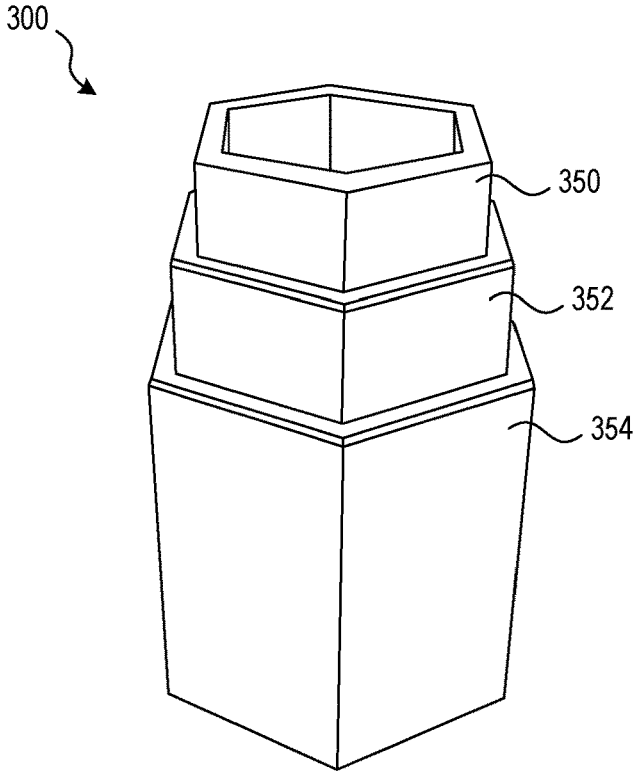
FIG. 3A is an isometric view of multiple sockets stacked together in accordance with embodiments of the present technology.
Figure 3B:
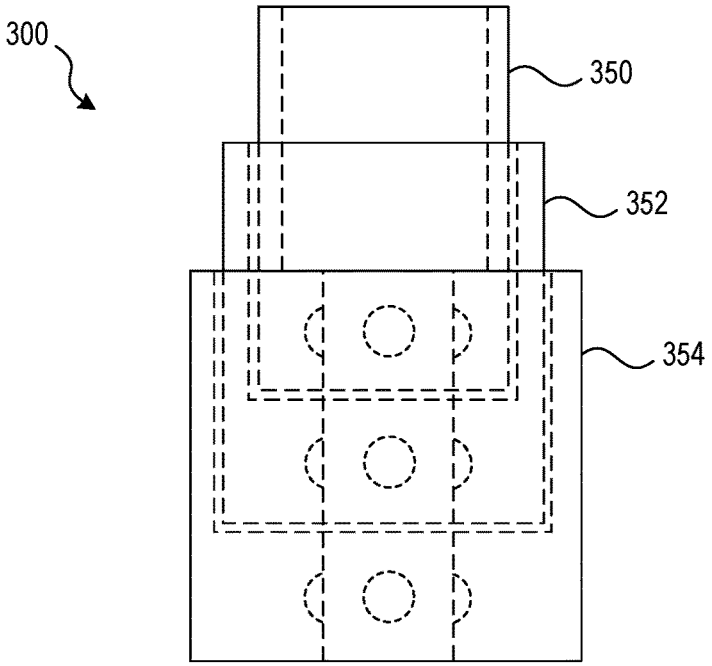
FIG. 3B is a cross-sectional side view of the multiple sockets of FIG. 3A.

FIG. 3A is an isometric view of multiple sockets 350, 352, 354 stacked together (e.g., over one another), and FIG. 3B is a cross-sectional side view of the multiple sockets of FIG. 3A. Any one of the sockets 350, 352, 354 (collectively referred to as "sockets 300") can correspond to the socket 100 previously described. As shown in FIGS. 3A and 3B together, the socket 352 is received by the socket 354 or, more specifically, by a first recess of the socket 354, and the socket 350 is received by the socket 352 or, more specifically, by a first recess of the socket 352. Stacking multiple sockets on top of one another in the manner shown in FIGS. 3A and 3B can provide a convenient and compact way to store multiple sockets, as opposed to traditional sockets which cannot be stacked due in part to their round outer surface, and thus must be stored separate from one another. It is worth noting that the sockets 300 can still be utilized for their desired function even when stacked. For example, a drive member can be inserted into the second recess of the socket 354 for turning a member the socket 350 is coupled to. As another example, the outer surface of the socket 354 can be gripped and turned by an adjustable wrench for turning a nut the socket 350 is coupled to. In such embodiments, the stacked sockets 300 can also beneficially be used to increase the surface area that can be gripped, relative to an individual socket. This can be particularly helpful when a user is attempting to turn a nut in a hard-to-reach area and/or orientation.

Figure 4:
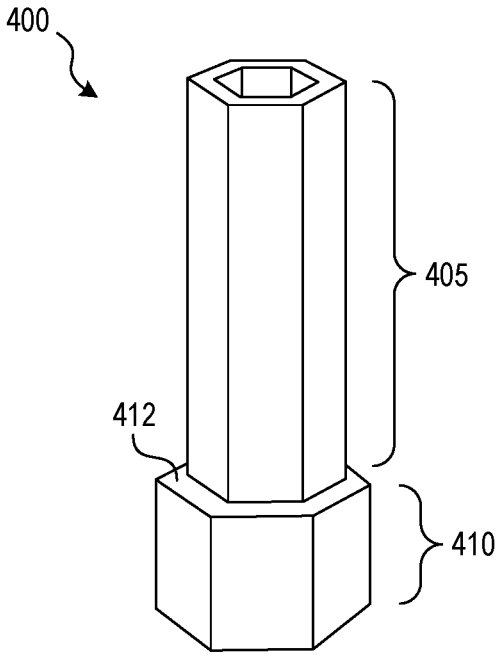
FIGS. 4 and 5 are isometric views of sockets configured in accordance with embodiments of the present technology.

FIG. 4 is an isometric view of a socket 400 configured in accordance with additional embodiments of the present technology. The socket 400 includes features generally similar to those of the sockets (e.g., the socket 100) described elsewhere herein, but includes a first portion 405 having a first outer cross-sectional dimension, and a second end portion 410 having a second outer cross-sectional dimension bigger than the first outer cross-sectional dimension. The first portion 405 can have a first length and the second portion 410 can have a second length shorter than the first length. In some embodiments, the second cross-sectional dimension can correspond to a standard dimension that multiple sockets with different sized first recesses (e.g., 5 mm, 6 mm, 7 mm, etc.) have, thereby enabling a single wrench to be used for each of the multiple sockets. Additionally or alternatively, the second portion 410 can include an upper face 412, which advantageously provides an abutting surface for a wrench gripped over the first portion 405 and makes the socket 400 easier to turn.

Figure 5:
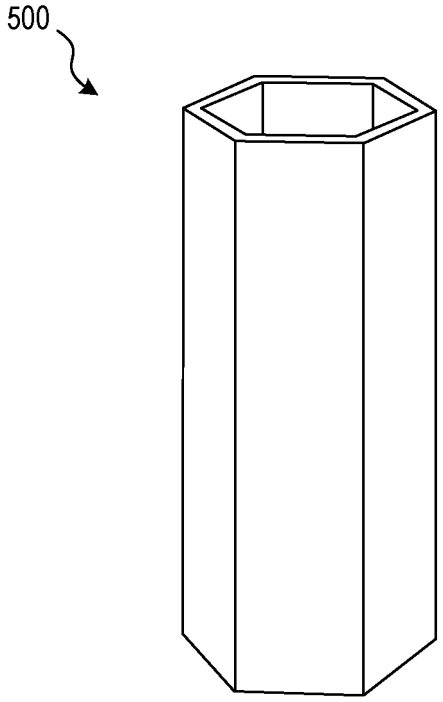

FIG. 5 is an isometric view of a socket 500 configured in accordance with further embodiments of the present technology. The socket 500 includes features generally similar to those of the sockets described elsewhere herein (e.g., the socket 100), but is generally more elongate. Advantageously, the elongate nature of the socket 500 is expected to provide more surface to be gripped by a wrench for turning, particularly when trying to turn a nut in a hard-to-reach area and/or orientation.

Figure 6:
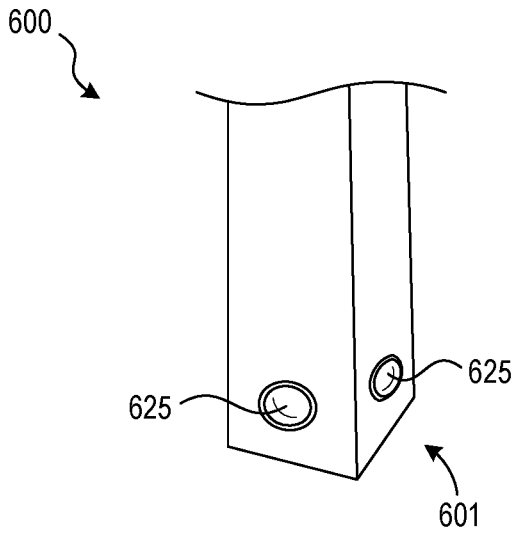
FIG. 6 is a drive member configured to be coupled to a socket and configured in accordance with embodiments of the present technology.

FIG. 6 is a portion of a drive member 600 configured to be coupled to a socket described herein (e.g., the socket 100, 350, 352, 354, 400, 500). The drive member 600 includes an end portion 601, and protrusions 625 configured to be received by depressions (e.g., the depressions 125) of a socket (e.g., the socket 100). The drive member 600 can comprise a ratchet, adapter, or other device configured to be coupled to a socket.

Figure 7:
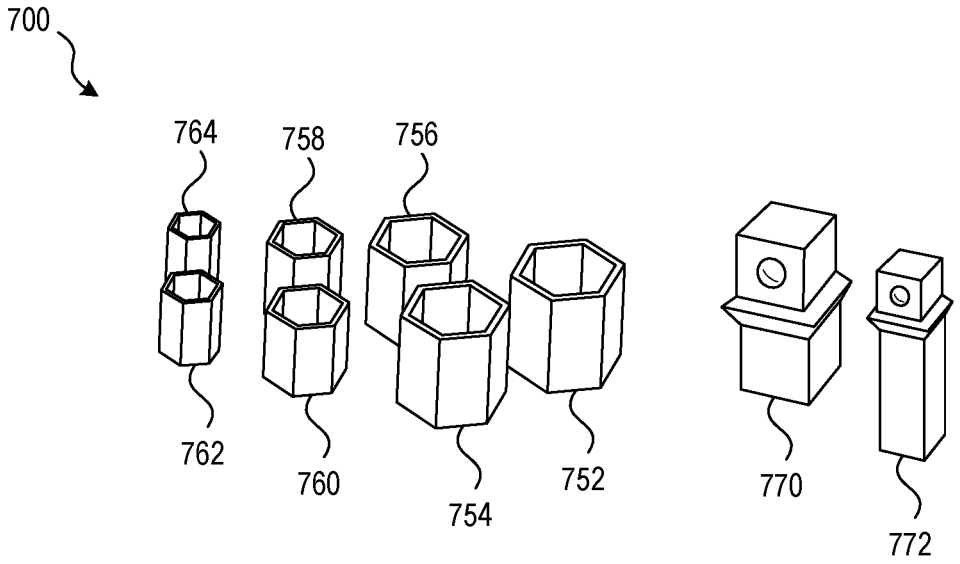
FIG. 7 is an isometric view of a kit including multiple sockets and drive members configured in accordance with embodiments of the present technology.

FIG. 7 is an isometric view of a kit 700 including multiple sockets 752, 754, 756, 758, 760, 762, 764 and drive members 770, 772 configured in accordance with embodiments of the present technology. Individual ones of the sockets 752, 754, 756, 758, 760, 762, 764 can each have different sized first recesses and thus be configured to turn different sized nuts, and individual ones of the driver members 770, 772 can include different sizes (e.g., a ½" drive and a ⅜" drive). As described herein, individual sockets 752, 754, 756, 758, 760, 762, 764 are stackable and can be stacked on top of and/or partially within one another.

C. Conclusion

It will be apparent to those having skill in the art that changes may be made to the details of the above-described embodiments without departing from the underlying principles of the present disclosure. In some cases, well known structures and functions have not been shown or described in detail to avoid unnecessarily obscuring the description of the embodiments of the present technology. Although steps of methods may be presented herein in a particular order, alternative embodiments may perform the steps in a different order. Similarly, certain aspects of the present technology disclosed in the context of particular embodiments can be combined or eliminated in other embodiments. Furthermore, while advantages associated with certain embodiments of the present technology may have been disclosed in the context of those embodiments, other embodiments can also exhibit such advantages, and not all embodiments need necessarily exhibit such advantages or other advantages disclosed herein to fall within the scope of the technology. Accordingly, the disclosure and associated technology can encompass other embodiments not expressly shown or described herein, and the invention is not limited except as by the appended claims.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising," "including," and "having" should be interpreted to mean including at least the recited feature(s) such that any greater number of the same feature and/or additional types of other features are not precluded.

Reference herein to "one embodiment," "an embodiment," "some embodiments" or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

Unless otherwise indicated, all numbers expressing concentrations, shear strength, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present technology. At the very least, and not as an attempt to limit the application of the doctrine of equivalents to the scope of the claims, each numerical parameter should at least be construed in light of the number of reported significant digits and by applying ordinary rounding techniques. Additionally, all ranges disclosed herein are to be understood to encompass any and all subranges subsumed therein. For example, a range of "1 to 10" includes any and all subranges between (and including) the minimum value of 1 and the maximum value of 10, i.e., any and all subranges having a minimum value of equal to or greater than 1 and a maximum value of equal to or less than 10, e.g., 5.5 to 10.

The disclosure set forth above is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Aspects of the present technology are described below, and various examples of the present technology are described as numbered clauses (1, 2, 3, etc.) for convenience. These clauses are provided as examples and do not limit the present technology. It is noted that any of the dependent clauses may be combined in any combination, and placed into a respective independent clause. The other clauses can be presented in a similar manner.

1. A socket configured to engage a hexagonal member, the socket comprising:

an outer surface comprising multiple outer sides including a first outer side, a second outer side extending from the first outer side, a third outer side extending from the second outer side, a fourth outer side extending from the third outer side, a fifth outer side extending from the fourth outer side, and a sixth outer side extending from the fifth outer side to the first outer side;

an inner surface comprising multiple inner sides including a first inner side, a second inner side extending from the first inner side, a third inner side extending from the second inner side, a fourth inner side extending from the third inner side, a fifth inner side extending from the fourth inner side, and a sixth inner side extending from the fifth inner side to the first inner side;

a first end portion;

a second end portion opposite the first end portion;

a first recess extending from the first end portion toward the second end portion, the first recess including a first cross-sectional dimension; and a second recess extending from the second end portion toward the first end portion, the second recess including a second cross-sectional dimension smaller than the first cross-sectional dimension.

2. The socket of any one of the clauses herein, wherein the multiple inner sides define the first recess.

3. The socket of any one of the clauses herein, wherein the second recess has a square shape or no more than four sides.

4. The socket of any one of the clauses herein, wherein the socket has a length, and wherein the first recess extends to an intermediate portion of the socket along the length and the second recess extends to the intermediate portion of the socket along the length, the intermediate portion being closer to the second end portion than the first end portion.

5. The socket of any one of the clauses herein, wherein at the first end portion:

the first inner side is parallel to the first outer side, the second inner side is parallel to the second outer side, the third inner side is parallel to the third outer side, the fourth inner side is parallel to the fourth outer side, the fifth inner side is parallel to the fifth outer side, and the sixth inner side is parallel to the sixth outer side.

6. The socket of any one of the clauses herein, wherein the inner surface is spaced apart from the outer surface to define a wall thickness, the wall thickness being uniform around a circumference of the socket at the first end portion.

7. The socket of any one of the clauses herein, wherein the multiple outer sides extend along an entire length of the socket, and wherein the multiple inner sides extend only a portion of the entire length.

8. The socket of any one of the clauses herein, wherein the socket has a uniform outer cross-sectional dimension along an entire length of the socket.

9. The socket of any one of the clauses herein, wherein the socket is a single component comprising a continuous surface extending along an entirety of the socket.

10. The socket of any one of the clauses herein, wherein the first cross-sectional dimension is at least 0.250 inches and the second cross-sectional dimension is at least 0.375.

11. The socket of any one of the clauses herein, wherein the outer surface has a hexagonal shape.

12. The socket of any one of the clauses herein, wherein the socket comprises steel or a rigid polymer.

13. A device configured to engage and rotate a member, the device comprising:

an outer surface comprising multiple outer sides extending along an entire length of the device;

an inner surface comprising multiple inner sides;

a first end portion;

a second end portion opposite the first end portion;

a first recess extending from the first end portion toward the second end portion, the first recess including a first cross-sectional dimension; and a second recess extending from the second end portion toward the first end portion, the second recess including a second cross-sectional dimension smaller than the first cross-sectional dimension.

14. The device of any one of the clauses herein, wherein the multiple inner sides define the first recess, and wherein the second recess has less than six sides.

15. The device of any one of the clauses herein, wherein the device has a uniform outer cross-sectional dimension along an entire length of the device.

16. The device of any one of the clauses herein, wherein the device has a length, and wherein the first recess extends to an intermediate portion of the device along the length and the second recess extends to the intermediate portion of the device along the length, the intermediate portion being closer to the second end portion than the first intermediate portion.

17. The device of any one of the clauses herein, wherein the outer surface has a hexagonal shape.

18. A kit, comprising:

a first socket comprising— an outer surface comprising multiple outer sides including a first outer side, a second outer side extending from the first outer side, a third outer side extending from the second outer side, a fourth outer side extending from the third outer side, a fifth outer side extending from the fourth outer side, and a sixth outer side extending from the fifth outer side to the first outer side;

an inner surface comprising multiple inner sides including a first inner side, a second inner side extending from the first inner side, a third inner side extending from the second inner side, a fourth inner side extending from the third inner side, a fifth inner side extending from the fourth inner side, and a sixth inner side extending from the fifth inner side to the first inner side;

a first end portion;

a second end portion opposite the first end portion;

a first recess extending from the first end portion toward the second end portion, the first recess including a first cross-sectional dimension; and a second recess extending from the second end portion toward the first end portion, the second recess including a second cross-sectional dimension smaller than the first cross-sectional dimension; and a second socket, wherein the first recess of the first socket is configured to receive the second socket.

19. The kit of any one of the clauses herein, wherein the second socket has a first end portion and a first recess at the first end portion of the second socket, the kit further comprising a third socket, wherein the first recess of the second socket is configured to receive the second socket.

20. The kit of any one of the clauses herein, further comprising a drive member, wherein the second recess of the first socket and the second recess of the second socket are each configured to receive the drive member.

I claim:

1. A socket configured to engage a hexagonal member, the socket comprising:

an outer surface comprising multiple outer sides including a first outer side, a second outer side extending from the first outer side, a third outer side extending from the second outer side, a fourth outer side extending from the third outer side, a fifth outer side extending from the fourth outer side, and a sixth outer side extending from the fifth outer side to the first outer side;

an inner surface comprising multiple inner sides including a first inner side, a second inner side extending from the first inner side, a third inner side extending from the second inner side, a fourth inner side extending from the third inner side, a fifth inner side extending from the fourth inner side, and a sixth inner side extending from the fifth inner side to the first inner side;

a first end portion;

a second end portion opposite the first end portion;

a first recess extending from the first end portion toward the second end portion, the first recess including a first cross-sectional dimension, wherein— the first recess is sized and shaped to receive an additional socket having an outer surface comprising multiple outer sides, the multiple outer sides extend along an entire length of the socket, and when the additional socket is received at least partially within the first recess, the multiple outer sides of the socket are parallel to the multiple outer sides of the additional socket; and a second recess extending from the second end portion toward the first end portion, the second recess including a second cross-sectional dimension smaller than the first cross-sectional dimension.

2. The socket of claim 1, wherein the multiple inner sides define the first recess.

3. The socket of claim 1, wherein the second recess has a square shape or no more than four sides.

4. The socket of claim 1, wherein the first recess extends to an intermediate portion of the socket along the length and the second recess extends to the intermediate portion of the socket along the length, such that the second recess is accessible via a tool extending from the first end portion through the first recess.

5. The socket of claim 1, wherein at the first end portion:

the first inner side is parallel to the first outer side, the second inner side is parallel to the second outer side, the third inner side is parallel to the third outer side, the fourth inner side is parallel to the fourth outer side, the fifth inner side is parallel to the fifth outer side, and the sixth inner side is parallel to the sixth outer side.

6. The socket of claim 1, wherein the inner surface is spaced apart from the outer surface to define a wall thickness, the wall thickness being uniform around a circumference of the socket at the first end portion.

7. The socket of claim 1, wherein the socket has a uniform outer cross-sectional dimension along an entire length of the socket.

8. The socket of claim 1, wherein the socket is a single component comprising a continuous surface extending along an entirety of the socket.

9. The socket of claim 1, wherein the outer surface comprises a third cross-sectional dimension at the first end portion, and wherein the first cross-sectional dimension is at least 0.250 inch and the third cross-sectional dimension is at least 0.375 inch.

10. The socket of claim 1, wherein the outer surface has a hexagonal shape.

11. The socket of claim 1, wherein the socket comprises steel or a rigid polymer.

12. A device configured to engage and rotate a member, the device comprising:

an outer surface comprising multiple outer sides such that the outer surface is non-round, the outer surface extending along an entire length of the device;

an inner surface comprising multiple inner sides such that the inner surface is non-round;

a first end portion;

a second end portion opposite the first end portion;

a first recess extending from the first end portion toward the second end portion, the first recess including a first cross-sectional dimension, wherein the first recess is sized and shaped to receive an additional socket having an outer surface comprising multiple outer sides, and wherein, when the additional socket is received at least partially within the first recess, the multiple outer sides of the socket are parallel to the multiple outer sides of the additional socket; and a second recess extending from the second end portion toward the first end portion, the second recess including a second cross-sectional dimension smaller than the first cross-sectional dimension.

13. The device of claim 12, wherein the multiple inner sides define the first recess, and wherein the second recess has less than six sides.

14. The device of claim 12, wherein the device has a uniform outer cross-sectional dimension along an entire length of the device.

15. The device of claim 12, wherein the first recess extends to an intermediate portion of the device along the length and the second recess extends to the intermediate portion of the device along the length, such that the second recess is accessible via a driver tool extending through the first end portion.

16. The device of claim 12, wherein the outer surface has a hexagonal shape.

17. A kit, comprising:

a first socket comprising— an outer surface comprising multiple outer sides including a first outer side, a second outer side extending from the first outer side, a third outer side extending from the second outer side, a fourth outer side extending from the third outer side, a fifth outer side extending from the fourth outer side, and a sixth outer side extending from the fifth outer side to the first outer side;

an inner surface comprising multiple inner sides including a first inner side, a second inner side extending from the first inner side, a third inner side extending from the second inner side, a fourth inner side extending from the third inner side, a fifth inner side extending from the fourth inner side, and a sixth inner side extending from the fifth inner side to the first inner side;

a first end portion;

a second end portion opposite the first end portion;

a first recess extending from the first end portion toward the second end portion, the first recess including a first cross-sectional dimension, wherein the multiple outer sides extend along an entire length of the socket; and a second recess extending from the second end portion toward the first end portion, the second recess including a second cross-sectional dimension smaller than the first cross-sectional dimension; and a second socket having multiple outer sides, wherein the first recess of the first socket is sized and shaped to receive the second socket, and wherein, when the second socket is received at least partially within the first recess of the first socket, the multiple outer sides of the first socket are parallel to the multiple outer sides of the second socket.

18. The kit of claim 17, wherein the second socket has first end portion and a first recess at the first end portion of the second socket, the kit further comprising a third socket, wherein the first recess of the second socket is configured to receive the second socket.

19. The kit of claim 17, further comprising a drive member, wherein the second recess of the first socket and the second recess of the second socket are each configured to receive the drive member.

20. The kit of claim 17, wherein, when the second socket is received at least partially within the first recess of the first socket, turning the outer surface of the first socket causes the second socket to rotate.

* * * * *